US011925301B1

(12) United States Patent
Hayward

(10) Patent No.: US 11,925,301 B1
(45) Date of Patent: Mar. 12, 2024

(54) MAGNETIC BROOM ASSEMBLY

(71) Applicant: Michael J. Hayward, Morgan Hill,, CA (US)

(72) Inventor: Michael J. Hayward, Morgan Hill,, CA (US)

( * ) Notice: Subject to any disclaimer, the term of this patent is extended or adjusted under 35 U.S.C. 154(b) by 0 days.

(21) Appl. No.: 18/146,089

(22) Filed: Dec. 23, 2022

(51) Int. Cl.
*A47L 13/41* (2006.01)
*A47L 13/42* (2006.01)

(52) U.S. Cl.
CPC ..... *A47L 13/41* (2013.01); *A47L 13/42* (2013.01)

(58) Field of Classification Search
CPC ..... A47L 13/41; A47L 13/42
USPC ..... 209/215, 417, 418, 419
See application file for complete search history.

(56) References Cited

U.S. PATENT DOCUMENTS 4,407,038 A * 10/1983 Haase ..... B03C 1/30 15/105
5,664,276 A * 9/1997 Arias ..... A47L 11/4072 15/44
6,113,169 A * 9/2000 Gohman ..... B03C 1/284 209/215
6,158,792 A * 12/2000 Snider ..... B03C 1/30 209/215
6,677,846 B2 * 1/2004 Snider ..... A47L 13/40 335/302
8,104,620 B2 1/2012 Lin et al.
8,157,101 B2 * 4/2012 Arnold ..... B03C 1/0332 209/418
8,602,220 B1 * 12/2013 Porter ..... B03C 1/284 209/418
10,252,409 B2 * 4/2019 Pruiett ..... A46B 13/023
2003/0043005 A1 * 3/2003 Snider ..... H01F 7/0257 335/284
2007/0084759 A1 * 4/2007 Shiao ..... B03C 1/14 209/221
2008/0078698 A1 * 4/2008 Lin ..... B03C 1/08 209/215
2017/0000309 A1 * 1/2017 Wadd ..... B03C 1/30

FOREIGN PATENT DOCUMENTS

CN 109602354 A * 4/2019 ..... A47L 13/10
CN 216167288 U * 4/2022

OTHER PUBLICATIONS

Hayward, Michael, HD Sweeper, Facebook page, Feb. 7, 2015, Tiny URL: https://tinyurl.com/2p8fhs7e, Full URL: www.facebook.com/100063568271390/videos/348931731970846?_so_=permalink.

(Continued)

*Primary Examiner* — Terrell H Matthews
(74) *Attorney, Agent, or Firm* — Donald J. Pagel

(57) ABSTRACT

A magnetic sweeper assembly comprised of a broom for sweeping up debris and a magnetic surface for picking up magnetic materials such as nails or metal shavings. The magnetic sweeper comprises a one-piece manifold having a brush cap, a curvilinear section, and a box section. One or more magnets are positioned in a cavity inside of the box section and the broom is attached to the brush cap. A shield is attached to the assembly adjacent to a side of the box section so that the magnetic items picked up by the magnets are held against the shield for eventual removal. Two or more wheels are attached to the assembly so the assembly can be rolled across the floor when the magnetic surface is employed.

19 Claims, 11 Drawing Sheets

(56) References Cited

OTHER PUBLICATIONS

Hayward, Michael, HD Sweeper, Screenshot of Facebook page containing Feb. 7, 2015 video, Tiny URL: https://tinyurl.com/2p8fhs7e, Full URL: www.facebook.com/100063568271390/videos/348931731970846?_ so_=permalink.
Hayward, Michael, U.S. Appl. No. 14/996,217, filed Jan. 14, 2016, now abandoned.
Shields Magnetics, Screenshot of web page, URL www.shieldscompany.com/product/ez-clean-magnetic-broom/, downloaded Oct. 16, 2020.
Wikipedia Entry, Halbach Array, https://en.wikipedia.org/wiki/Halbach_array, pp. 1-2, downloaded May 22, 2023.

* cited by examiner

MAGNETIC BROOM ASSEMBLY

TECHNICAL FIELD

This invention relates to cleaning apparatus, and more particularly to a magnetic sweeper apparatus.

BACKGROUND OF THE INVENTION

Stables, construction sites, machine shops, garages and similar work areas often accumulate significant amounts of metallic particles such as nails, screws, metal shavings, and other metallic debris. If such loose or sharp debris is not immediately removed, they can lead to falls, cuts, or puncture wounds, as well as penetrating and damaging vehicle tires, damaging footwear, or injuring animals (for example, such as horses in a stable).

Stray metallic particles in a work area may also get transported to other areas where they can damage carpet and other flooring. Collecting ferrous materials from a floor or work area may avoid these problems and may also help with collecting and reclaiming usable items, such as nails, screws, and other metal components that may be retrieved and separated from other types of debris.

Sweeping metallic particles with a conventional broom is burdensome and ineffective since the particles easily adhere to underlying surfaces. Magnet sweepers are known, but they require a user to carry separate tools for sweeping and lifting metallic debris.

Thus, there remains a need for a robust, cost-effective apparatus and method for that easily and efficiently removes metallic particles from a floor. The present invention addresses this need by providing a single device that allows a user to sweep a floor or other surface of debris and lift metallic particles.

SUMMARY OF THE INVENTION

Apparatus, systems, and methods described herein provide a robust and cost-effective tool for selectively sweeping surfaces and removing metallic particles.

In some embodiments, a magnetic broom or sweeper comprises a broom head assembly having a body with an elongated magnet attached to a front or upper surface of the body. A plurality of bristles may extend from a lower surface of the body, for example broom bristles for sweeping a floor. The magnet bar may be secured to or integrated within a front edge of the body, and the head assembly may include one or more wheels which allow the head assembly to be rolled across a surface when the assembly is turned over. In such an orientation, the magnet bar is held above the surface to be cleaned such that metallic or other magnetically attractive particles or items are collected by the magnet. One or more notches in body may be configured and dimensioned to accommodate the wheels such that the wheels may freely rotate without interference from the body or the bristles. In some embodiments, a broom handle may be removably attached to the head, for example for a user to hold when operating the broom assembly.

In some embodiments, a sweeper head assembly includes a body having a plurality of bristles extending from a lower surface of the body, and a magnet bar secured to or integrated within a front edge of the body. The magnet bar may include a long axis substantially parallel to a long axis of the body. A first wheel may be secured to a first end of the magnet bar, and a second wheel may be secured to a second end of the magnet bar. The body may include a first cutout within which the first wheel is rotatably secured and a second cutout within which the second wheel is rotatably secured.

In some embodiments, a sweeper comprises a sweeper head having a magnet secured to a surface of the sweeper head and a magnet release assembly adapted to release debris from being held by the magnet. In some embodiments, a magnet release assembly may comprise a conductive shield or cover that covers the magnet, wherein the shield may be moved with respect to the magnet to remove or decrease the strength of the magnetic field acting on or through the shield such that metallic objects may be magnetically attached to the shield when the shield is in close proximity to the magnet and such object may be released from the shield when the shield is moved away from the magnet. In some embodiments, the shield may be secured to a head of the sweeper by a hinge, such that the shield may be rotated about the hinge to activate or deactivate the magnetic force acting through the shield. In some embodiments, a release assembly may include a lever, handle, pulley, slide, or other mechanism adapted to move the shield with respect to the magnet.

In some embodiments, the magnet may be rotated with respect to a shield or other pick-up surface, such that rotation of the magnet within the head may selectively activate, deactivate, or otherwise alter the magnetic field around the pick-up surface. For example, the magnet may comprise a magnetic bar disposed within the sweeper head and having a long axis that may be substantially parallel to a long axis of the sweeper head. In such embodiments, the magnet may be rotated about its axis to selectively direct a magnetic field from the magnet toward or away from the shield or pick-up surface of the broom assembly. E.g., rotating to direct the field toward the pick-up surface will "activate" the head to attract and retain metallic debris on the shield or pick-up surface, and rotation of the magnet away from the shield or pick-up surface will allow such debris to fall away, e.g., to discard the debris into a waste container.

In some embodiments, the magnetic sweeper assembly is comprised a one-piece manifold having a brush cap, a curvilinear section, and a box section. One or more magnets are positioned in a cavity inside of the box section and the broom is attached to the brush cap. A shield is attached to the assembly adjacent to a side of the box section so that the magnetic items picked up by the magnets are held against the shield for eventual removal. Two or more wheels are attached to the assembly so the assembly can be rolled across the floor when the magnetic surface is employed.

DETAILED DESCRIPTION

Figure 1:
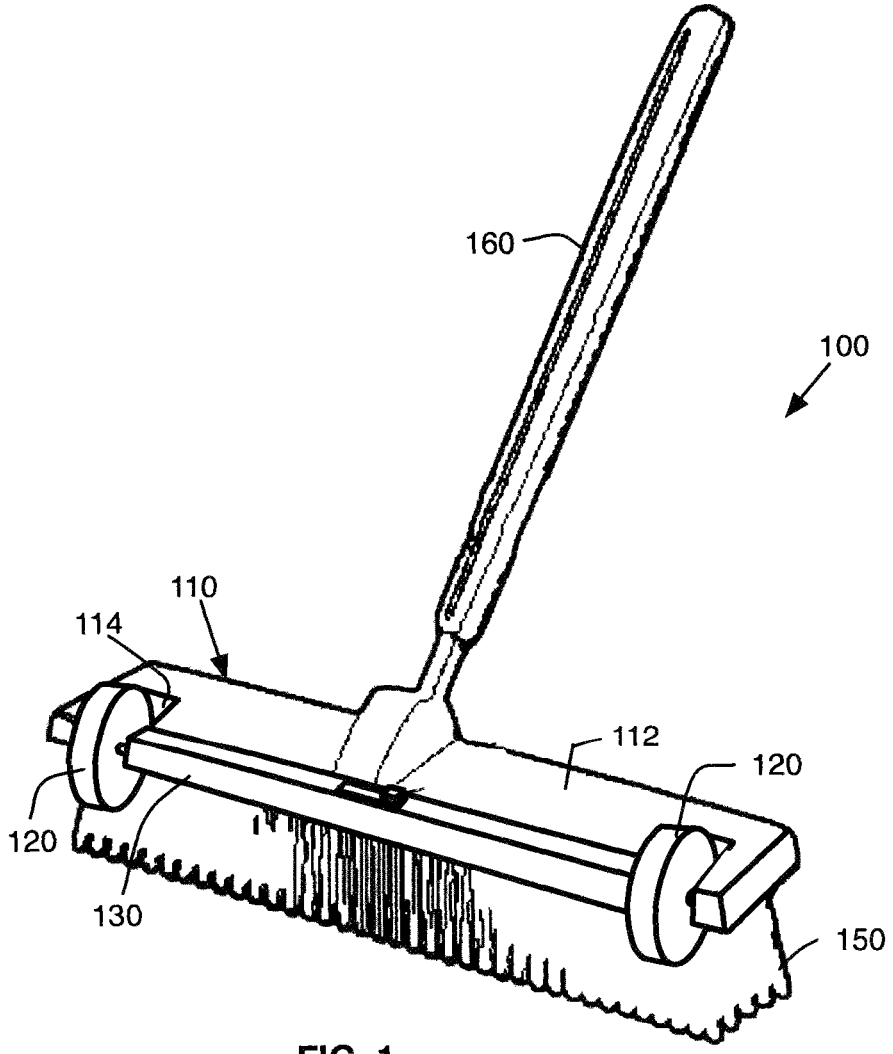
FIG. 1 is a perspective view of a magnetic broom assembly in accordance with an example embodiment.

Referring to FIG. 1, an example embodiment of a magnetic broom assembly 100 may include a head assembly 110 having a body 112 and a plurality of bristles 150 extending therefrom. A magnet bar 130 may be secured to or integrated within the body, e.g., secured at a front edge of the body 112 as shown in FIG. 1, or integrated within or secured to another desired part of body head assembly 110. Head assembly 110 may include one or more wheels 120, for example attached to opposite ends of the magnet bar 130. One or more notches 114 in the body 112 may be configured and dimensioned to accommodate wheels 120. In some embodiments, a broom handle 160 may be removably attached to the head 112, for example for a user to hold when operating the broom assembly 100.

Figure 2:
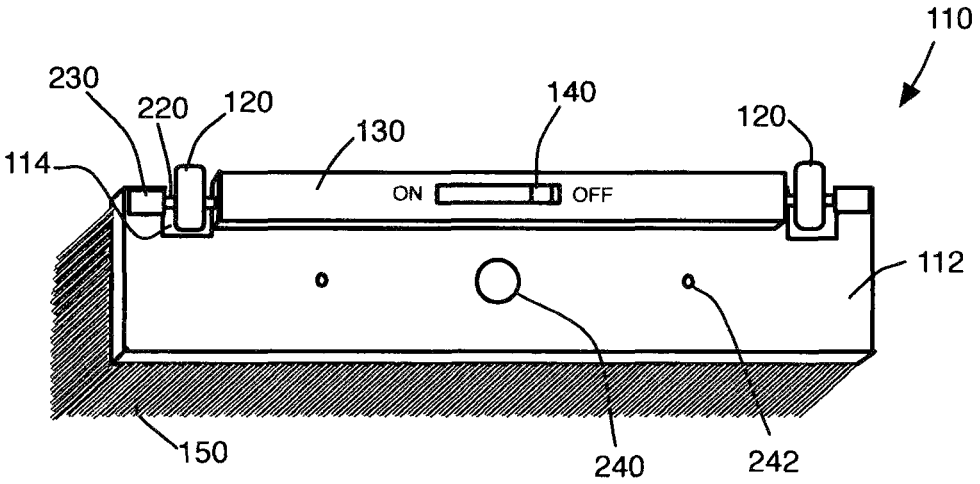
FIG. 2 is a top view illustration of a magnetic broom head assembly in accordance with an example embodiment.

Referring to FIG. 2, a top view schematic illustration of the head assembly 110 is shown. Body 112 may be a substantially rigid material, e.g., plastic, wood, resin, metal or other desired material. A plurality of bristles or other brush material may extend from an underside of body 112. A hole 240 or other attachment point in body 112 may be threaded or otherwise configured and dimensioned to accept a broom handle or other device. Additional holes 242, attachment points, or other features may be integrated within or attached to body 112 as desired.

In some embodiments, the magnet bar 130 is secured to the body 112. In some embodiments, bar 130 may be dimensioned as an elongated rectangular prism, having a long axis that is substantially parallel with a long axis of the body 112. Wheels 120 rotatably attached to each end of the bar 130 allow the head assembly to be rolled on the ground, floor, or other surface such that the magnetic bar 130 remains a desired distance from the surface as the head is rolled on the wheels 120. In some embodiments, each wheel may be rotatably attached by an axel 220. In some embodiments, one or more retainers 230, housings or other fixtures or features may be secured to or integrated within body 112, e.g., near the outer edges of body 112 on opposite sides of the magnetic bar 130, to hold axel 220 and/or help secure the bar 130 to body 112. A front edge of body 112 may include one or more cutouts 114 for accommodating the wheels 120 and allowing the wheels to rotate freely in the cutout spaces without interference from the body 112 or bristles 150.

In a preferred embodiment, the magnets or magnetic bar 130 comprise permanent magnets. For example, permanent magnetics comprised of neodymium or neodymium iron boron magnets, alnico magnets, samarium cobalt magnets may be used, as can other known magnetic materials. For example, in some embodiments, a plurality or array of individual neodymium magnets are employed, e.g., arranged in an elongated fashion to form a magnetic bar member. In some embodiments, a Halbach array of magnets is employed to provide optimal magnetic characteristics.

In some embodiments the magnetic bar 130 could be an electromagnetic that would require an external power supply such as an AC current supply from a household power source or a DC current supply from a battery. In such an embodiment, an on-off switch 140 may be located on the head assembly 110 to turn the magnet on or off.

In some embodiments, a hinged or otherwise movable metallic (or magnetically conductive) guard, shield, tray, or other feature (sometimes generically referred to herein as a "shield" or pick-up surface), may be placed over a lower surface of magnet, such that moving the shield may decrease or remove the magnetic field to release any metallic objects picked up by the magnet and adhered to the shield when the shield is near the magnet.

In some embodiments, a scraper feature or other mechanism may be employed to assist in release or removal of metallic debris collected by the magnet. In other embodiments, the magnet may be configured and dimensioned as a magnetic bar that is rotatable with respect to the broom head and/or shield, such that rotation of the magnetic bar may selectively position a magnetic surface of the bar in a desired proximity with respect to the shield or pickup surface, e.g., to activate, deactivate, or otherwise control the strength of the magnetic field for attracting metallic debris to the pick-up surface.

Figure 3:
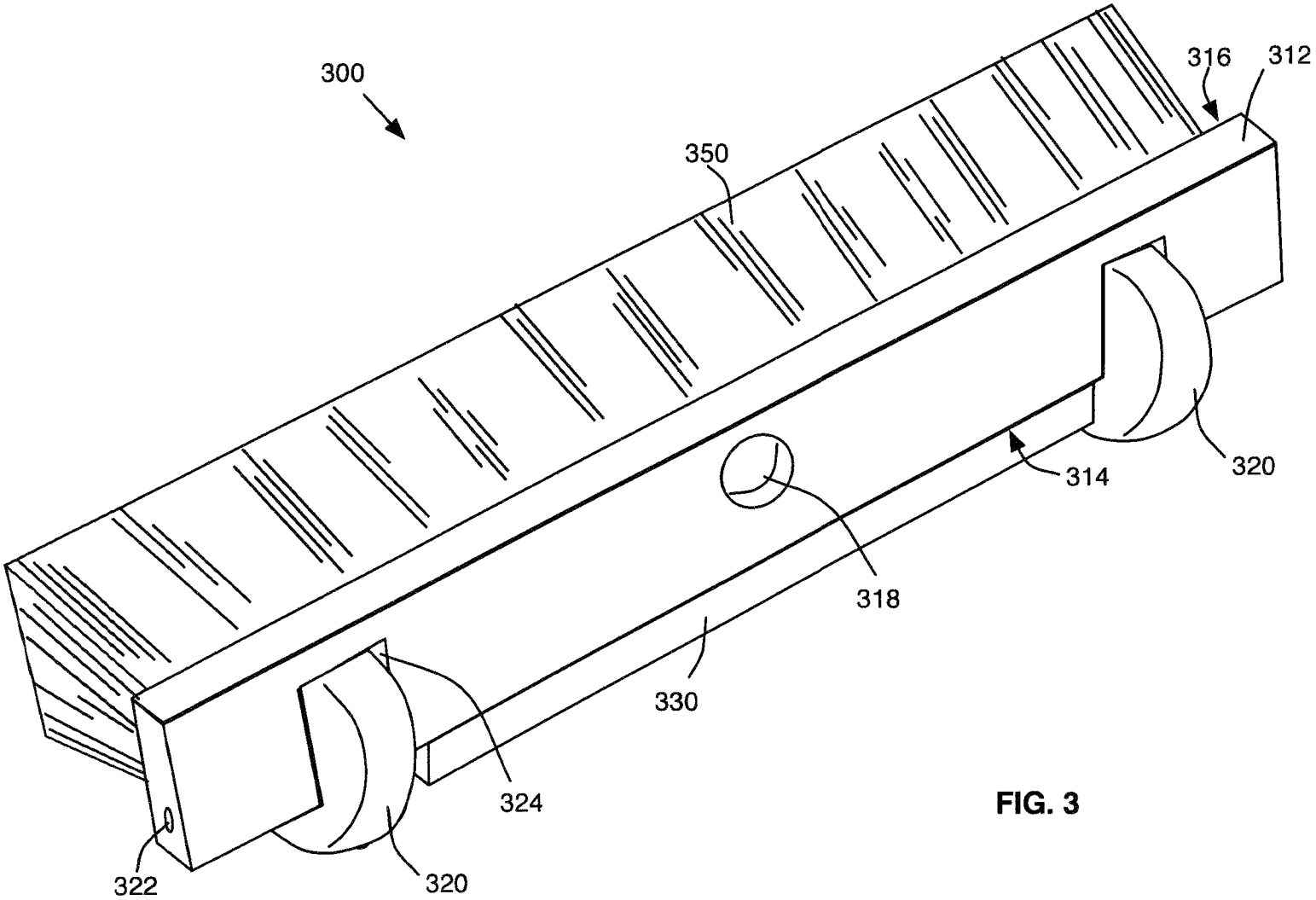
FIG. 3 is rear perspective view illustration of another example embodiment of a magnetic broom head assembly.

Turning now to FIG. 3, a magnetic broom assembly 300 may include a head body 312 (also called head 312) having a first surface 316 (e.g., a lower surface) having a plurality of bristles 350 or other brush or sweeper members extending therefrom. In some embodiments, a handle attachment aperture 318 (e.g., a threaded hole adapted to receive a threaded broom handle) may be integrated within or attached to head 312, e.g., for securing a broom handle to extend from a surface which may be opposite from the first surface 316.

Head 312 may include one or more cutouts 324, each adapted to hold one or more wheels 320 within head such that a portion of each wheel 320 extends from a second surface 314 of head 312. When the broom assembly 300 is oriented with the wheels 320 down and the wheels contact the ground, a floor, or other substantially planar surface (generically referred to herein as the "ground"), surface 314 may be positioned a desired distance away from the ground. Wheels 320 may be rotatably attached to head 312 by a bar, pin, axel 322 or other member rotatably secured to a central portion of each wheel 320.

In some embodiments, assembly 300 may also include a magnet 330 secured to or integrated within head body 312 such that magnet 330 is positioned a distance away from the ground to provide a desired magnetic field strength and direction for picking up and retaining ferrous or other magnetically attractive objects from the ground (also referred to herein as "pick-up strength"). In some embodiments, magnet 330 may be disposed within a housing within or attached to head 312 and may incorporate a mechanism for selecting or adjusting the pick-up strength. In some embodiments, such mechanism may comprise a shield, guard, or other member that covers the magnet and is movable with respect to the magnet (or the magnet is movable with respect to the shield) to activate, deactivate or adjust the pick-up strength of the magnet.

In some embodiments, the magnet may be configured and dimensioned as an elongated member having a long axis substantially parallel with a long axis of the head 312 or axel 322. In such embodiments, the magnet 330 may be adapted to be movable within the head 312 and/or with respect to the second surface 314, e.g., to move the magnet closer to the ground or to retract the magnet 330 within the head 312.

Figure 4:
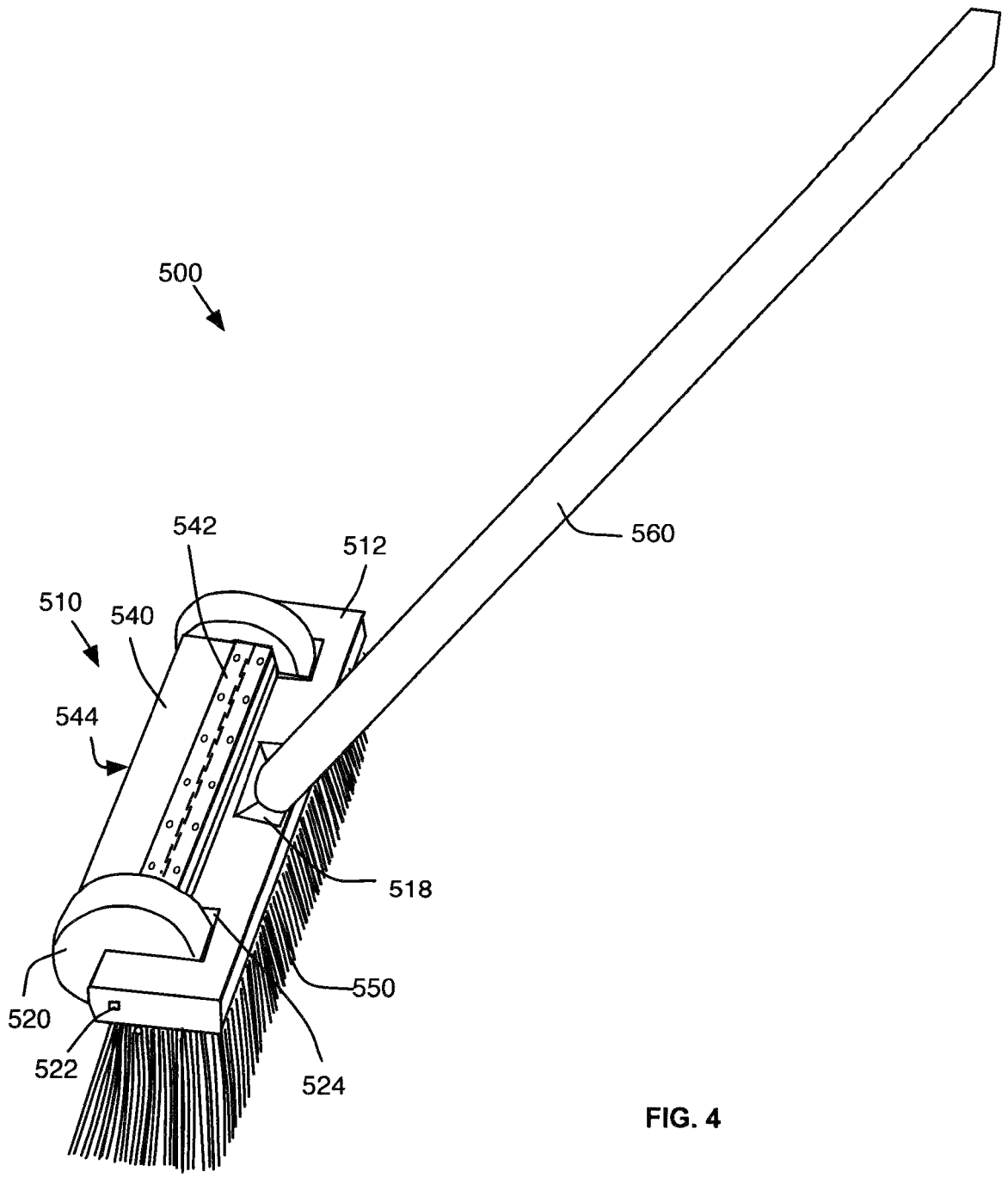
FIG. 4 is a top perspective view illustration of a magnetic broom assembly in accordance with another example embodiment.

FIG. 4 shows another embodiment of a magnetic broom assembly 500 having a head assembly 510 and a handle 560 attached to an attachment region 518 on a body 512 of the head assembly 510. As described with respect to embodiments above, body 512 may have a lower surface with a broom member 500 extending therefrom. The broom member 500 preferably comprises bristles for sweeping but could also comprise other cleaning members such as a brush or sponge. One or more wheels may be rotatably secured to or within body 512 as shown, e.g., by a rod or other axel member 522 extending through at least a portion of a long axis of the body 512.

Figure 5A:
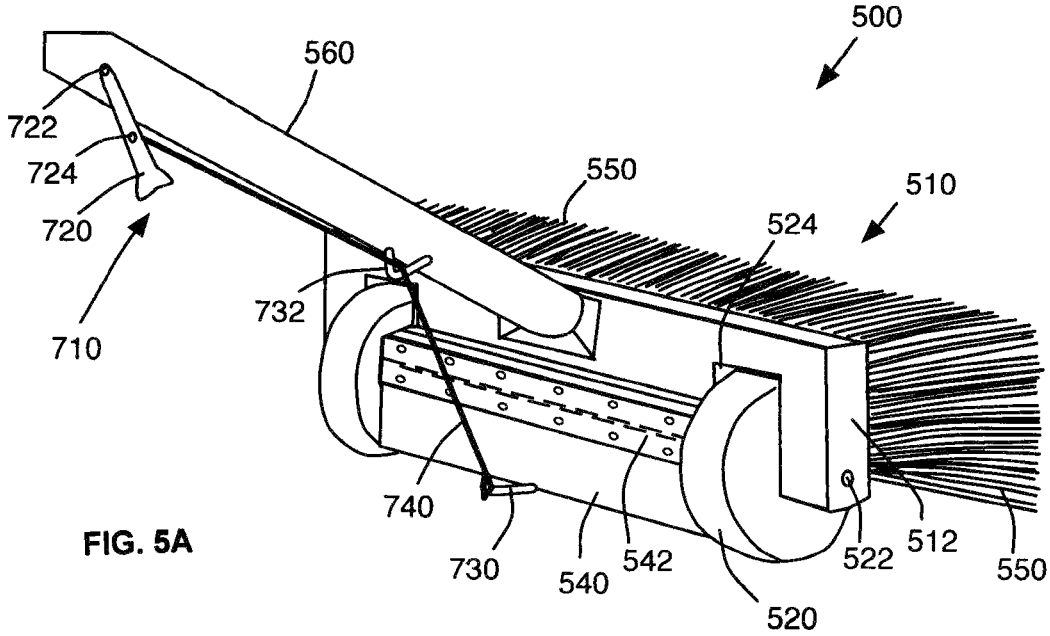
FIG. 5A is a perspective view illustration of the magnetic broom head of the assembly of FIG. 5, showing a shield deployed over a magnet.

In the magnetic broom assembly 500, a magnet or magnet assembly (such as the magnet 630 shown in FIG. 5B) is covered by a movable shield 540 that, when in position covering the magnet, conducts the magnetic field emanating from the magnet to pick up metallic objects and retain them against a lower surface 544 of the shield 540 when the head assembly 510 is oriented with wheels 520 on the ground (e.g., as shown in FIG. 5A). Shield 540 may be secured to body 512 by a hinge member 542 or other member that allows shield 540 to move its position toward or away from the magnet, e.g., to decrease the strength or direction of the magnet with respect to the shield 540 and release the retained metallic objects.

Figure 5B:
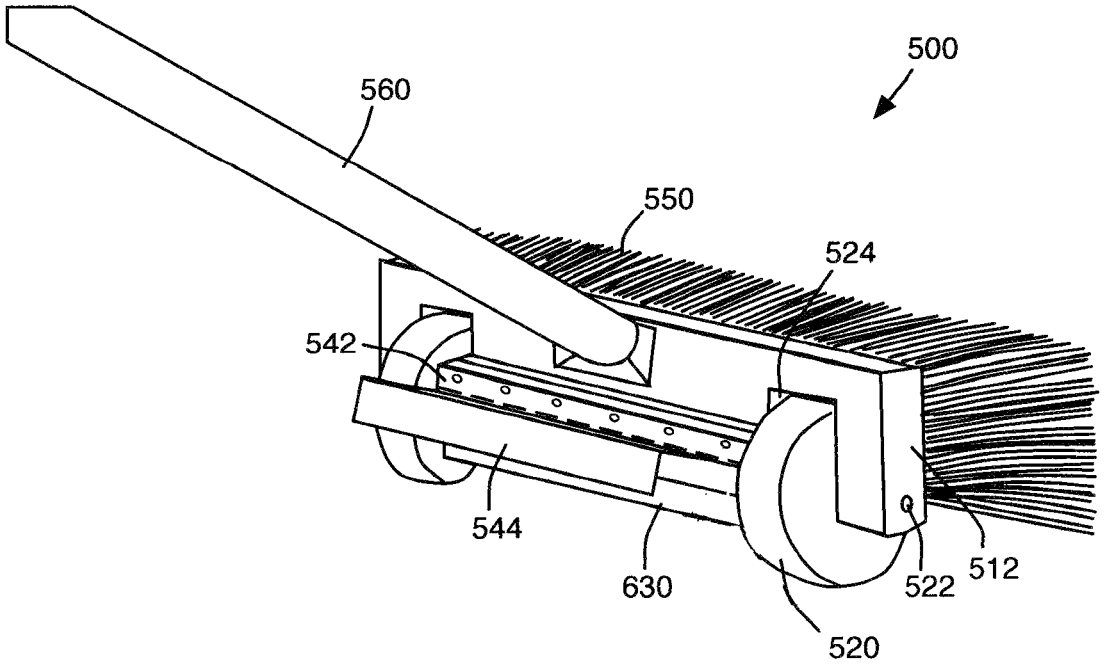
FIG. 5B is a perspective view illustration of the magnetic broom head of FIG. 5A showing the shield removed from the magnet in accordance with an example embodiment.

Turning to FIGS. 5A and 5B, assembly 500 of FIG. 4 is shown with the shield 540 deployed or covering the magnet (FIG. 5A) and with shield 540 removed (lifted) from the magnet 630 (FIG. 5B). In an example of use, the shield 540 may be deployed as shown in FIG. to pick up ferrous or magnetically attractive debris or materials and retain them (e.g., against side or lower surface 544 of shield) when the shield 540 is in place over the magnet 630. When release of the picked-up debris is desired (e.g., to discard the debris into the trash), the user may rotate the shield 540 as shown in FIG. 5B (e.g., using the hinge 542 and the lever mechanism 710 described below), to decrease or remove the magnetic pick-up force acting on the shield 540 thereby releasing the debris.

In some embodiments, an activation/release lever, button or other mechanism may be employed. For example, as shown in FIG. 5A, a lever mechanism 710 may include a handle 720 pivotably attached to the handle 560, e.g., at a pivot member or point 722. A rope, wire, strap, or other linkage member 740 may attach to the handle 720, e.g., at a point 724 and attach to an anchor member 730 on the shield 540 to rotate the shield as described above. A guide member 732 may be attached to or integrated within handle, for example, to direct linkage member 740 to provide a desired angle for rotation of the hinged shield 540. The lever mechanism 710 is not shown in FIG. 5B.

In an example of use, a magnetic broom assembly (e.g., assembly 100 or 500 as shown and described with respect to FIGS. 1, 4, 5A, and 5B) may be oriented with the bristles down (e.g., as shown in FIGS. 1 and 4), such that the bristles may contact the ground, floor or other surface to be cleaned, and the apparatus may be used as a normal push broom to sweep debris from the surface. To pick up metallic objects, the head assembly 510 may be turned over (e.g., as shown in FIGS. 5A and 5B), such that wheels 520 engage the ground or other surface to be cleaned of metallic debris. In such embodiments, turning the head assembly 510 in this manner allows the wheels to engage the ground and positions the magnetic bar 630, and/or the pick-up surface 540 covering the bar as shown in FIG. 4, to a desired distance, e.g., 0.5 inches to 2 inches (or any desired distance depending upon the strength of the magnet) above the ground The distance can be chosen based on various considerations, such as the size and/or weight of the metallic objects to be collected.

In some embodiments, the height of the magnet 630 (or the distance of the magnet from the ground in operation) may be adjusted by a user. With wheels 520 placed on the ground as shown in FIGS. 5A and 5B, and the shield 540 positioned so as to cover the magnet bar 630, the assembly 500 is rolled across the floor or other surface to attract ferrous or other magnetically attractive materials. These materials adhere to the shield 540 because of the magnetic field from the magnet bar 630 acts through or on the shield 540. After a desired amount of material is collected, a user may swing the shield 540 away from the magnet bar 630 to release the materials from the head, e.g., to discard, reuse or recycle the metallic particles or items.

Figure 6:
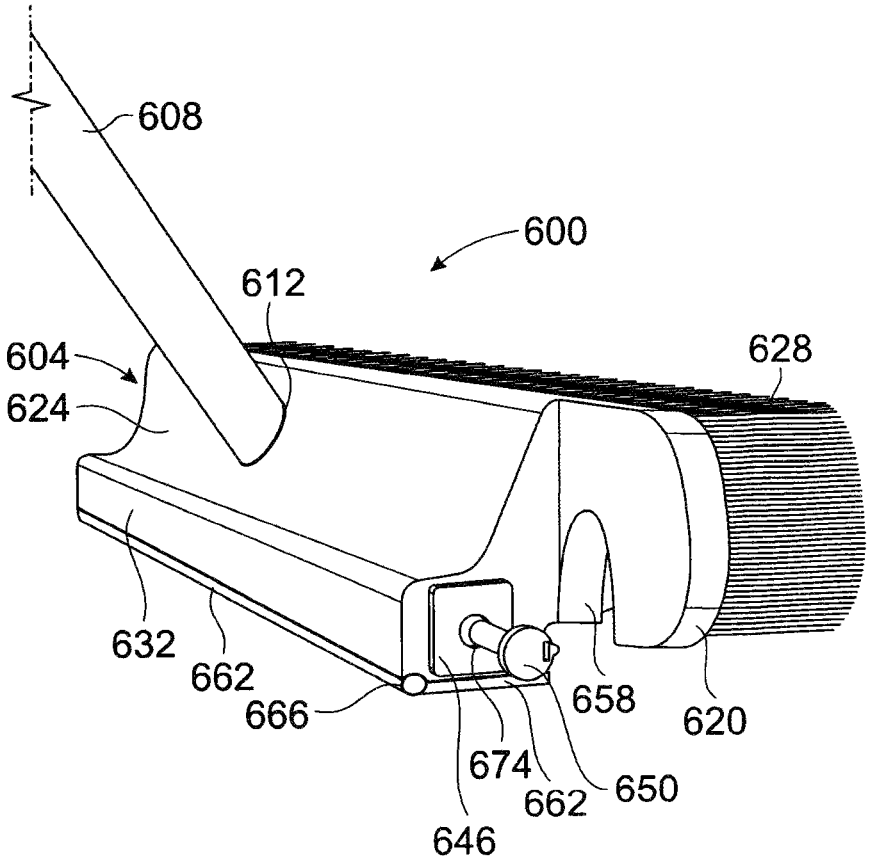
FIG. 6 is a side view of a magnetic broom assembly.
Figure 7:
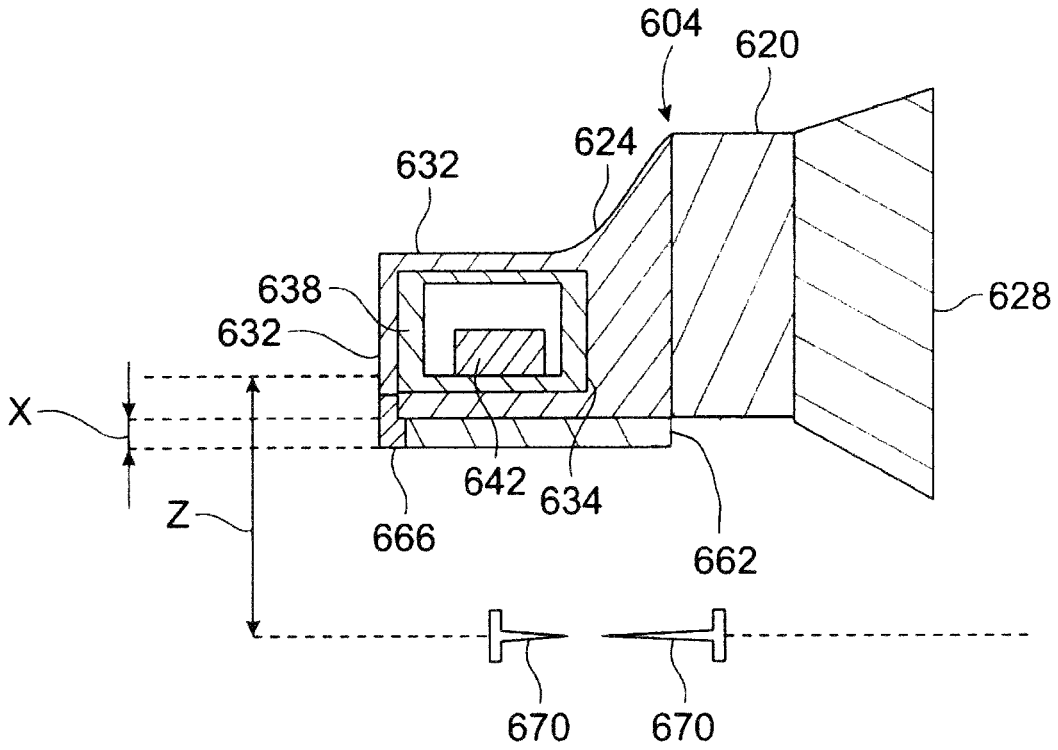
FIG. 7 is a cross-sectional view of a head assembly of a magnetic broom assembly.

FIG. 6 shows another embodiment of a magnetic broom assembly 600 having a head assembly 604 and a handle (shaft) 608. In a preferred embodiment, the head assembly 604 includes a brush cap 620, a curvilinear (sloped) section 624, and a box section 632. The brush cap 620 secures a brush 628 in place and the curvilinear section 624 is positioned between the brush cap 620 and the box section 632. The handle 608 is attached to the head assembly 604 at an attachment region 612 such as a hole in the curvilinear section 624. The brush cap 620 is just a region of the head assembly 604 to which the brush 628 is attached when the magnetic broom assembly 600 is fully assembled. Preferably the brush cap 620 is a flat edge of the head assembly 604 as is illustrated in FIGS. 6 and 7. The brush cap 620 can just be an end of the curvilinear section 624 to which the brush 628 is attached.

Figure 8:
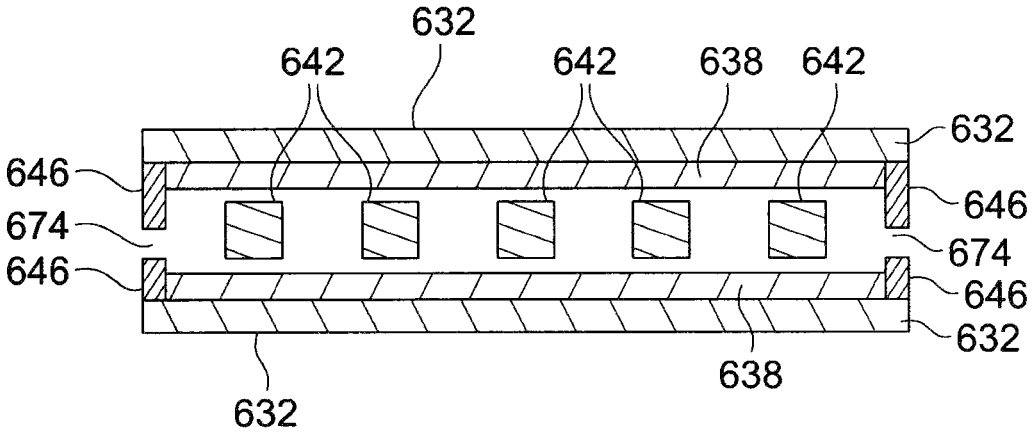
FIG. 8 is a cross-sectional top view of a container holding the magnets in a magnetic broom assembly.

The box section 632 extends along one side of the curvilinear section 624 and provides a structure for holding one or more magnets 642 (shown in FIGS. 7 and 8). In a preferred embodiment, the box section 632 is an elongated section of the assembly 604, preferably having a rectangular prism or cuboid shape that extends in a direction parallel to the length of the brush cap 620. Other shapes or configurations for the box section 632 can be used. The box section 632 includes a cavity 634 (shown in FIG. 7) into which a cartridge 638 can be inserted. The cartridge 638 is a hollow container sized to hold the one or more magnets 642. In a preferred embodiment, the cartridge 638 is rectangular in shape, but other shapes can be used.

In a preferred embodiment, each of the two ends of the box section 632 are closed by an end member 646. An aperture 674 is positioned in each of the end members 646 (one aperture 674 is shown in FIG. 6). Each of the two apertures 674 accept an axle 650 to which one or more wheels 654 (shown in FIG. 10) can be attached. One or more notches 658 are formed in the head assembly 604, such as in the brush cap 620, to provide a space for the wheels 654 to fit into. A rotatable shield 662 is positioned under one side of the box section 632. The shield 662 is analogous in function and purpose to the shield 540 shown in FIGS. 4, 5A and 5B. The shield 662 comprises a piece of material that is separate from the head assembly 604 and that rotates about a hinge 666. Preferably the shield 662 rotates at least forty-five degrees about the hinge 666 and more preferably at least about ninety degrees.

FIG. 7 is a cross-section of the head assembly 604 showing one of the magnets 642 positioned inside the cartridge 638. In a preferred embodiment, the magnets 642 are positioned inside the cartridge 638 in an arrangement that provides sufficient magnetic force to pick up small items 670 (i.e., items comprised of ferromagnetic or paramagnetic materials, or other items attracted to magnets) such as nails, iron shavings, or similar items that are located at a distance "z" away from the magnets 642. Preferably, the distance "z"

is at least two inches when measured from the items 670 to a surface of the magnets 642 closest to the items 670. In FIG. 7, the items 670 are resting on a surface such as a floor or the ground, and the head assembly 604 is in the position shown in FIG. 6 with the shield 662 between the magnets 642 and the items 670.

The shield 662 is positioned between the magnets 642 and the items 670 such that the magnetic field from the magnets 642 will cause the items 670 to be attracted to and held against the shield 662 when the items 670 are within the distance "z" of the magnets 642. Preferably the shield 662 comprises a non-magnetic or paramagnetic material so that it does not become permanently magnetized by the magnets 642 (or at least does not retain any magnetism when the shield 662 is rotated away from the magnets 642), but which allows the magnetic field from the magnets 642 to act on the items 670.

FIG. 7 illustrates that the curvilinear section 624 is just a sloped section of the head assembly 604 positioned between the box section 632 and the brush cap 620. The curvilinear section 624 has a thickness measured in the same direction as the thicknesses "X" and "Z" shown in FIG. 7. The thickness of the curvilinear section 624 is at a minimum adjacent to the box section 632 and increases to a maximum where the curvilinear section 624 is adjacent to the brush cap 632. In FIG. 7, the box section 632, the curvilinear section 624, and the brush cap 620 are illustrated as separate members, as indicated by the different cross-hatching. In practice, these three members could be separate parts attached together, or they could all be part of a single piece of material (single-piece construction). In a preferred embodiment, a single-piece construction is used. Also, in FIG. 7, the width of the brush cap 620 is exaggerated for illustration purposes but is more representatively illustrated in FIG. 6 and other figures.

FIG. 8 is a top cross-section of the cartridge 638 showing the one or more magnets 642 inside the cartridge 638, and the cartridge 638 inside the box section 632. In a preferred embodiment there are five of the magnets 642 although other numbers of magnets can be used. In a preferred embodiment, the five magnets are arranged in a Halbach array configuration so that the magnetic field from the magnets 642 is maximized going through the shield 662 in the direction of the items 670 shown in FIG. 7, while the magnetic field on the side of the magnets 642 facing away from the items 670 is minimized.

In preferred embodiments, the magnets 642 are permanent magnetics. In one preferred embodiment, the magnets 642 are comprised of neodymium, such as neodymium-iron-boron magnets. But the magnets 642 can be comprised of other magnetic materials, such as SmCo (samarium cobalt), ferrite (a ceramic material comprised of $Fe_2O_3$ and small amounts of other metals), strontium-iron ferrites, AlNiCo (aluminum-nickel-cobalt), iron-chromium-cobalt, as well as other magnetic materials used in permanent magnetics.

Figure 9:
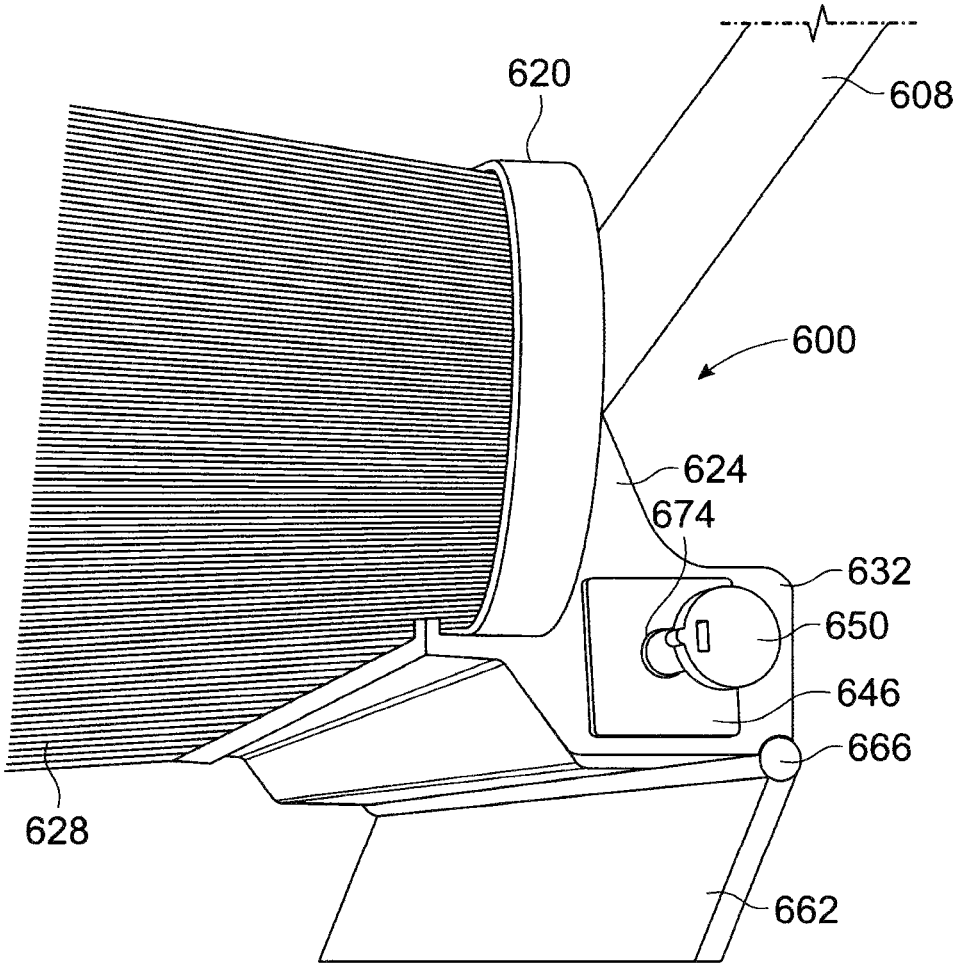
FIG. 9 is a side view of a magnetic broom assembly.

FIG. 9 illustrates the sweeper assembly 600 with the shield 662 in the "open" position so that the items 670 can be collected after they have been picked up by the sweeper assembly 600. In use, the shield 662 is held in the "closed" position so that the objects 670 will be held against the shield 662 because of the magnetic field emanating from the magnets 642. In a preferred embodiment, the shield comprises a paramagnetic material such as aluminum, but other materials can be used, such as other paramagnetic materials, temporary magnetic materials, and non-magnetic materials (such as plastic). The material requirement for the shield 662 is that the magnetic field from the magnets 642 can pass through the shield 662 to attract the items 670 without the shield 662 becoming permanently magnetized itself. The shield 662 can become slightly magnetized by the magnets 642 if it loses its magnetism when the shield 662 is moved away from the magnets 642. The thickness "X" of the shield 662 (shown in FIG. 7) can be chosen so that the desired magnetic field strength for picking up the items 670 is maintained.

When the assembly 600 is being used to pick up metal objects, the shield 662 is in the "closed" position shown in FIG. 7. The items 670 are attracted to the shield 662 by the magnetic field from the magnets 642 and are held against the shield 662 by the magnetic field. To remove the items 670 from the shield 662, the shield is moved to the "open" position shown in FIG. 9, such as by rotation about the hinge 666. In the open position, the magnetic field from the magnets 642 no longer acts on the shield 662, so the items 670 fall away from the shield 662 or can be scrapped off. The shield 662 can be moved from the closed to the open position by applying an appropriate force to the shield 662, for example by using your hand to swing the shield to the open position. This can also be accomplished by using a mechanical device such as the lever mechanism 710 illustrated in FIG. 5A.

Figure 10:
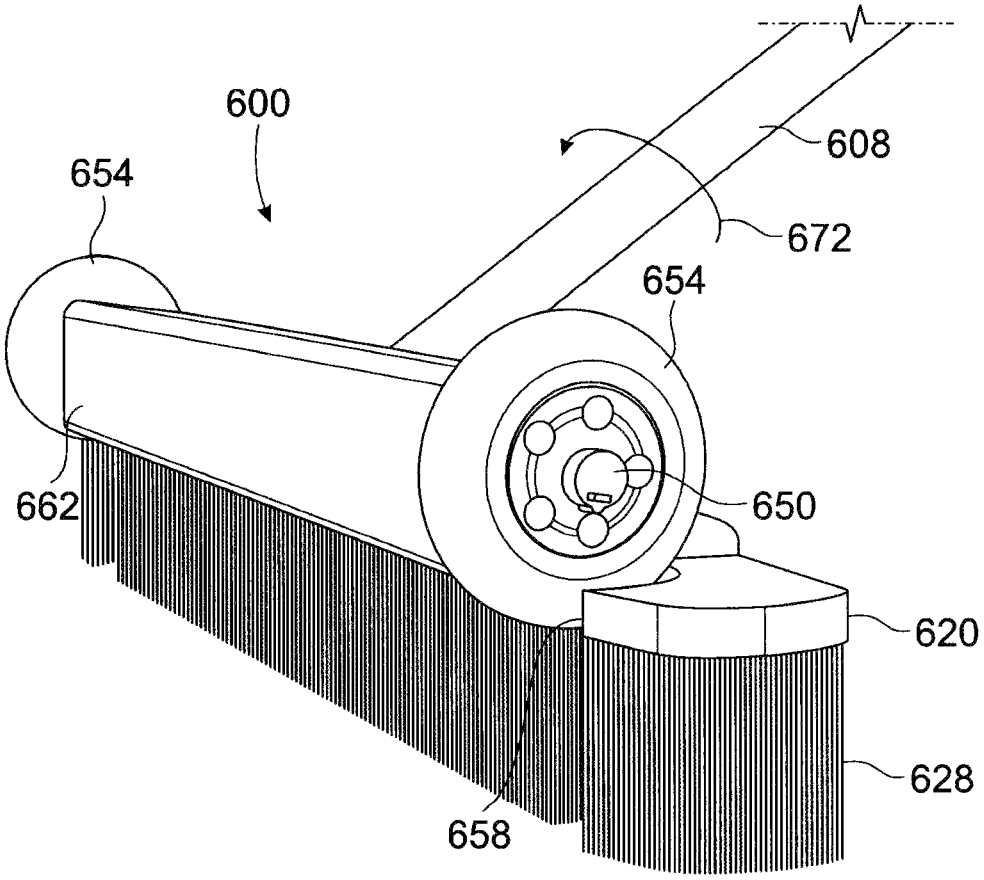
FIG. 10 is a top perspective view of a magnetic broom assembly.

FIG. 10 illustrates the sweeper assembly 600 fully assembled with the wheels 654 up so that the brush (broom) 628 can be used to sweep up dirt, dust, and/or other materials. By rotating the magnetic broom assembly 600 around the shaft 608, either the wheels 654 or the brush 628 can be positioned on the floor. Preferably, this rotation is accomplished by rotating the entire magnetic broom assembly 600 by one hundred and eighty degrees, for example by applying a twisting motion to the handle 608 as indicated by the arrow 672. The wheels 654 are positioned on the floor when the magnets 642 in the assembly 600 are being used to pick up the items 670. The wheels 654 allow the assembly 600 to be rolled across the floor in this mode of operation.

Figure 11:
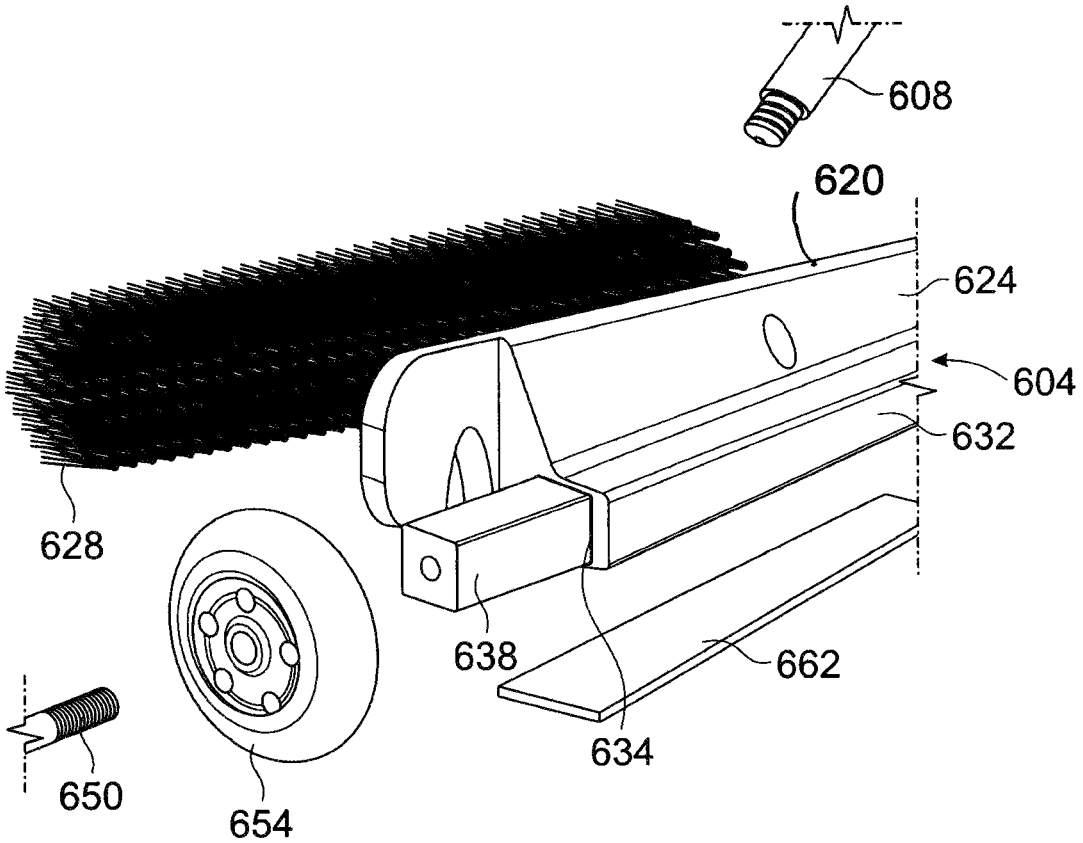
FIG. 11 is an exploded view of a magnetic broom assembly.

FIG. 11 is an exploded view of the sweeper assembly 600 illustrating a preferred embodiment for the sweeper assembly 600 in which the head assembly 604 consists of a single piece of material. FIG. 11 illustrates that the head assembly 604 (also referred to as the manifold 604) is comprised of the box section 632, the curvilinear section 624, and the brush cap 620, which are all part of a single piece of material. The cavity 634 is inside of the box section 632, and the cartridge 638 is a separate part from the manifold 604 that slides into the cavity 634.

In FIG. 11, the cartridge 638 is shown partially inserted into the cavity 634. The shield 662, the wheels 654, the axles 650, the brush 628 and the handle 608 are all separate parts from the manifold 604. The manifold 604 is made of a non-magnetic material that does not become magnetized by the magnets 642 or interfere with the magnetic field produced by the magnets 642. This is to prevent the items 670 from sticking to the manifold 604 because of magnetism produced by the magnets 642. For example, materials such as plastic, fiberglass, rubber, aluminum, austenitic stainless steel, and other non-magnetic materials are suitable for the manifold 604.

The cartridge 638 can be comprised of non-magnetic materials, such as those listed above, or from paramagnetic materials such as aluminum or copper, provided that the materials do not significantly diminish the strength of the magnetic field produced by the magnets 642. In any event, the thicknesses of the materials positioned between the magnets 642 and the items 670 (i.e., the thicknesses of the manifold 604 and the cartridge 638) should be chosen so that they do not significantly diminish the strength of the magnetic field produced by the magnets 642.

The brush 628 is comprised of a plurality of individual bristles that are attached to the brush cap 620. The brush 628 (i.e., the bristles) may be comprised of any material commonly used in brooms, including natural or synthetic bristles. Preferably, the brush 628 is comprised of a synthetic material such as extruded plastic for example, but natural materials such as broomcorn may also be used.

There are several advantages to the design of the sweeper assembly 600 shown in FIGS. 6-11. First, the single piece construction of the manifold 604 simplifies the manufacturing process for the head assembly 604. For example, the manifold 604 can be manufactured by molding or machining. Second, the combination of the cavity 634 and the cartridge 638 allows different configurations, types, and/or powers of the magnets 642 to be used without changing the design of the sweeper assembly 600. Third, the separate nature of the other components (e.g., the shield 662, the wheels 654, the axles 650, and the brush 628) allow these parts to be sourced separately (i.e., obtained from different sources) and/or to replaced or modified without significant trouble.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

I claim:

1. A sweeper assembly comprising:

a manifold having a box section and a brush cap section;

a cavity inside of the box section, with the brush cap section not positioned in the cavity;

one or more magnets positioned within the cavity for providing a magnetic force to pick up one or more ferromagnetic objects from a surface to be cleaned when the box section is positioned over the ferromagnetic objects at an effective distance for the magnetic force;

one or more wheels attached to the manifold, with at least one wheel being positioned to contact the surface when the box section is positioned to pick up the ferromagnetic objects from the surface;

a shield that extends parallel to the cavity and which can be positioned between the surface and the box section when the at least one wheel is in contact with the surface, the shield adapted for holding the ferromagnetic objects in place after they are picked up by the magnetic force; and a brush for sweeping debris from the surface, the brush comprising a plurality of bristles attached to the brush cap section, the brush oriented so that when the brush is touching the surface, none of the one or more wheels are touching the surface, whereby the brush can sweep debris from the surface when the wheels are not touching the surface and the magnets can cause the ferromagnetic items to be picked up from the surface when at least one of the wheels is touching the surface, with the ferromagnetic items being held against the shield after they are picked up.

2. The sweeper assembly of claim 1 further comprising:

a cartridge positioned inside of the cavity, with the one or more magnets being positioned inside of the cartridge.

3. The sweeper assembly of claim 1 further comprising:

a shaft attached to the manifold.

4. The sweeper assembly of claim 1 wherein the one or more wheels comprises two wheels.

5. The sweeper assembly of claim 1 wherein the one or more magnets comprise five individual magnets.

6. The sweeper assembly of claim 1 wherein the one or more magnets are comprised of neodymium.

7. The sweeper assembly of claim 1 further comprising a curvilinear section positioned between the box section and the brush cap section.

8. A sweeper assembly comprising:

a one-piece manifold having a brush cap section, a curvilinear section and a box section, with the curvilinear section being positioned between the brush cap section and the box section;

a cavity inside of the box section, with the brush cap section not positioned in the cavity;

one or more magnets positioned in the cavity for providing a magnetic force to pick up one or more ferromagnetic objects from a surface to be cleaned when the box section is positioned over the ferromagnetic objects at an effective distance for the magnetic force;

a brush attached to the brush cap section for sweeping debris from the surface, the brush being comprised of a plurality of bristles;

two or more wheels attached to the one-piece manifold, with at least two of the wheels being positioned to contact the surface when the box section is positioned to pick up the ferromagnetic objects from the surface and with none of the wheels contacting the surface when the brush is in contact with the surface; and a shield attached to the manifold that extends parallel to the cavity and which can be positioned between the surface and the box section when the wheels are in contact with the surface, the shield adapted for holding the ferromagnetic objects against the shield after they are picked up by the magnetic force.

9. The sweeper assembly of claim 8 further comprising:

a cartridge positioned inside of the cavity, with the one or more magnets being positioned inside of the cartridge.

10. The sweeper assembly of claim 8 wherein the curvilinear section abuts the box section and the brush cap section.

11. A manifold comprising:

a brush cap;

a brush for sweeping debris from a surface, the brush comprising a plurality of bristles attached to the brush cap;

a box section having a cavity extending through the box section for holding one or more magnets, with the brush cap not positioned in the cavity;

a curvilinear section positioned between the brush cap and the box section, the curvilinear section having a minimum thickness adjacent to the box section and a maximum thickness adjacent to the brush cap; and a shield attached to the box section so that the shield covers at least a part of the box section, with the shield being positioned so that it will be oriented away from the surface when the brush is sweeping debris from the surface.

12. The manifold of claim 11 further comprising:

a cartridge positioned inside of the cavity, with one or more magnets being positioned inside of the cartridge.

13. The manifold of claim 11 further comprising:

at least one wheel attached to the manifold; and a notch formed in the brush cap for accommodating at least part of the wheel.

14. The sweeper assembly of claim 8 wherein at least one of the one or more magnets comprises neodymium.

15. The sweeper assembly of claim 8 wherein the one or more magnets comprise a Halbach array.

16. The sweeper assembly of claim 10 wherein the curvilinear section has a minimum thickness adjacent to the box section and a maximum thickness adjacent to the brush cap section.

17. The manifold of claim 11 wherein the brush cap, the curvilinear section, and the box section are all part of a single piece of material.

18. The sweeper assembly of claim 1 wherein the effective distance is in the range of approximately 0.5 inches to 2 inches.

19. The sweeper assembly of claim 8 wherein the effective distance is in the range of approximately 0.5 inches to 2 inches.

* * * * *